United States Patent [19]

Paules

[11] 4,035,982

[45] July 19, 1977

[54] AUTOMATIC VACUUM PACKAGING MACHINE AND METHOD

[75] Inventor: Eugene H. Paules, Red Lion, Pa.

[73] Assignee: ExCel Engineering, Inc., Red Lion, Pa.

[21] Appl. No.: 737,198

[22] Filed: Oct. 29, 1976

[51] Int. Cl.[2] ..... B65B 31/06

[52] U.S. Cl. ..... 53/22 B; 53/30 S; 53/79; 53/112 B; 53/138 A; 53/184 S; 53/244

[58] Field of Search ..... 53/22 B, 305, 79, 112 B, 53/138 A, 184 S, 244, 250

[56] References Cited

U.S. PATENT DOCUMENTS

| | | | |
|---|---|---|---|
| 3,516,222 | 6/1970 | Klenz | 53/112 B X |
| 3,795,085 | 3/1974 | Andre et al. | 53/112 B |

*Primary Examiner*—Travis S. McGehee
*Attorney, Agent, or Firm*—C. Hercus Just

[57] ABSTRACT

A bag filling and sealing mechanism having vertical tubes over which elongated sleeve-like bags are positioned to receive a stack of similar patty-type products, a composite plunger unit movable into the upper end of a bag containing a guantity of said products, vacuum mechanism operable to apply vacuum to the interior of said bag while said plunger unit is withdrawn from the open upper end of said bag, a plunger coaxial with said plunger unit positioned with the lower end against the top of the stack of products in said bag while vacuum is still applied to contract the upper end of the bag around said plunger, transfer mechanism to move the evacuated bag to clipping mechanism to apply clips to the contracted end of the bag after said plunger has been fully withdrawn, heat-shrinking mechanism extending around said clipped bag, while supported at the upper end, and movable vertically between opposite ends of said bag to shrink it tightly around the contents thereof, and additional transfer mechanism operable to move the evacuated bags to cartons automatically to form an orderly pattern of the same in said cartons.

31 Claims, 16 Drawing Figures

AUTOMATIC VACUUM PACKAGING MACHINE AND METHOD

BACKGROUND OF THE INVENTION

In recent years, there has been tremendous growth in food preparing and serving establishments which operate somewhat on a short order basis and one of the principal products dispensed by such establishments are hamburgers. These hamburgers are formed by machines so as to be uniform in size and weight and the preferred shape thereof is that of a patty which more or less is of the order of about one half inch in thickness. Said patties are manufactured in large quantieies and in many instances are formed by automatic machines from a supply of ground meat. The patties are suitably molded to have uniform diameter as well as uniform thickness. These patties then are frozen to facilitate the handling and storage thereof and, individual patties are usually separated by thin sheets of suitable paper and are then packaged either in elogated cylindrical plastic bags or in cartons and then are maintained in frozen condition until the patties are to be cooked and served to the purchasing public.

The packaging of such patties into either cartons or elongated tubular bags heretofore has very largely been of a manual nature but due to salaries required by individuals to undertake such packaging, manual filling of the bags or cartons is a costly operation. Further, in view of the ever increasing consumption of hamburgers of the type referred to, certain food preparing establishments have been established solely for the purpose of packaging such hamburger patties and maintaining the same in frozen condition until delivered to establishments which cook the same and otherwise prepare them in the form of sandwiches and otherwise.

Quite recently, the placing of food products in bags and then evacuating the same has inspired the development of certain machines of which U.S. Pat. No. 3,648,740, in the name of Pruitt, dated Mar. 14, 1972, and U.S. Pat. No. 3,796,020, in the name of Anderson et al, dated Mar. 12, 1974, are representative of relatively current development in the food packaging industry. Neither of the patents referred to specifically show or contemplate means for packaging a stack of hamburger patties and the food products respectively illustrated in said patents comprise fowl and hams. Said machines however include vacuum arrangements for evacuating the package after the food product is enclosed within a plastic bag and considerable manual manipulation, especially in arranging the open end of the bag for evacuation, is required.

The present inventor also has developed certain automatic machines capable of feeding a series of patties sequentially by conveyors to deposit the same in stacked relationship within a flexible plastic bag. U.S. Pat. Nos. 3,849,969, in the name of Paules, dated Nov. 26, 1974, and 3,959,951, in the name of Paules, dated June 1, 1976 pertain to machines to perform the aforementioned feeding and stacking automatically. These patents also include the feature of inserting sheets of paper between individual patties so that even in frozen condition, they are more readily separable from each other. The machines comprising said inventions includehand-operated evacuating means for the bags after being filled with a full complement of hamburg patties, and they also contemplate using hand operated means for clipping the upper end of the bags after evacuation.

The machines of these patents, however, are a step forward in the marketing of frozen hamburg patties in that they are a vast improvement over solely manual operation in filling bags and cartons with such patties. Therefore, it is the principle purpose of the present invention to provide means which, with only a minor exception, are completely automatic and handle the bagged patties produced, for example, by either of the aforementioned machines in applicant's prior patents to effect evacuation of the bagged patties, automatically clipping the upper ends thereof closed, heat shrinking the bags when formed from heat shrinkable plastic material, automatically placing the evacuated and sealed bags in spaced therefor in a carton, which spaces are arranged by indexing means so as to receive and pack said bags of patties in orderly fashion to consume a minimum of space within the carton.

SUMMARY OF THE INVENTION

It is one of the principal objects of the invention to provide evacuating means which, after a bag has been filled with a full complement of patties by a machine, such as shown in U.S. Pat. No. 3,848,969, is arranged to have the excess bag material at the upper open end thereof manually placed around the lower end of said evacuating means and this manual step comprises the only manual manipulation of the products which subsequentially are evacuated to form a contracted neck in the upper end of the bag for application to clip-applying mechanism which clamps the contracted upper end of the bag to support the same in suspended manner while a circular heating element is moved from a position adjacent the lower end of said bag to the upper end thereof to heat-shrink the bag tightly around the products therein, followed by the steps of automatically placing said bags, as released by the clipping mechanism, into cartons which are suitably positioned and indexed to sequentially receive a plurality of such bags in orderly, compact arrangement, in which arrangement they are then automatically weighed and the weights recorded for purposes of insuring the full required weight to be contained in said cartons. It is another overall object of the invention to employ pneumatically operated valves actuated by electronic switches to accomplish all of the movements of the various elements and sectors of the present invention.

It is a further object of the invention to produce by automated means and a single operator results which otherwise would require ten or a dozen individual operators under circumstances where the packaging was undertaken largely by manual means.

Details of the foregoing objects and of the invention as well as other objects thereof, are set forth in the following specification and illustrated in the accompanying drawings comprising a part thereof.

DETAILED DESCRIPTION

Figure 1:
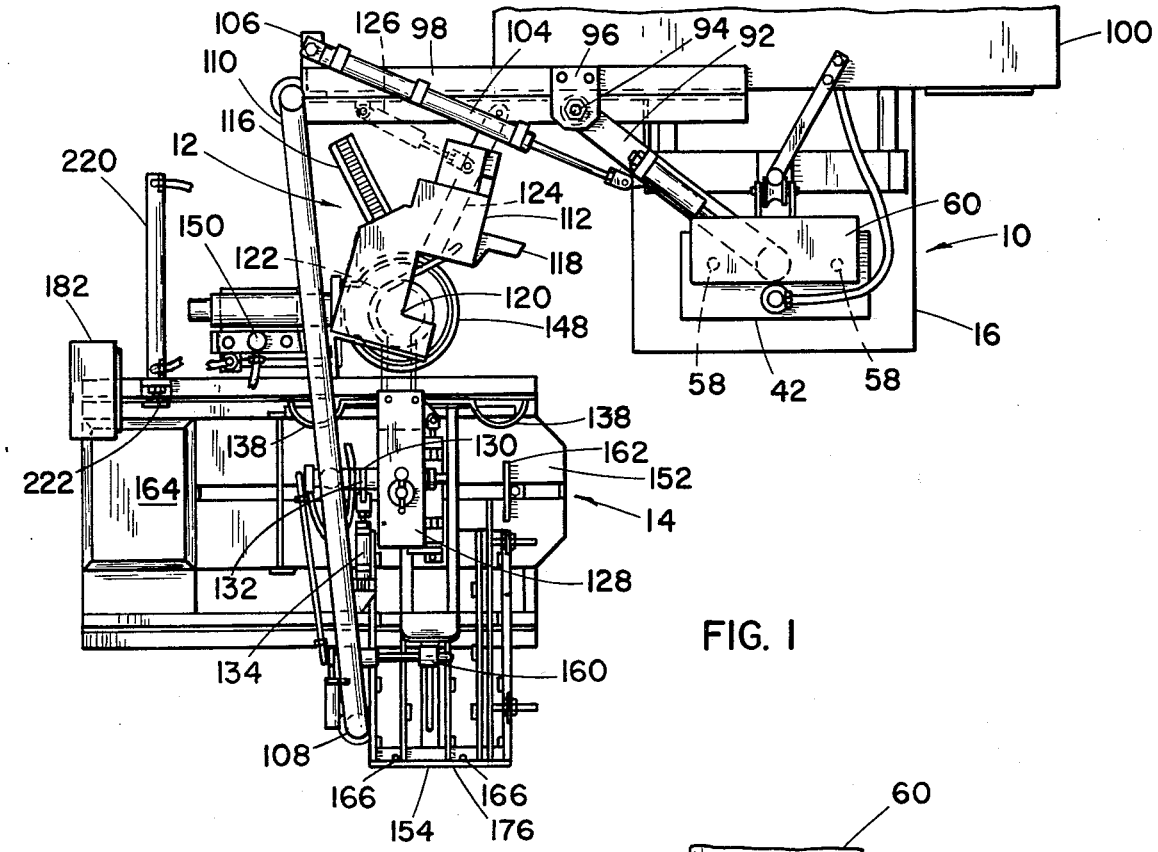
FIG. 1 is a top plan view of the machine embodying the invention.

The applicants prior patents referred to and especially U.S. Pat. No. 3,849,969, utilize a pair of tubular bag packing cylinders which are arranged so that flexible plastic bags may be placed thereover in inverted manner and while one bag is being loaded with oncoming patties which are depressed against the bag into the cylinder by reciprocating plunger, the second bag is ready to be switched into receiving position by movement around an axis of 180°, following which the loaded bag is removed manually from the first mentioned cylinder and suitable clipping mechanism is employed to apply a tightly fitting clip to the upper end of the bag. Evacuation of said bag is performed manually by a hand nozzle in said patents. Also, in the normal operation of said machines one employee can pack only four or five bags per minute and for greater production, two employees are required.

In contrast to the foregoing, while the present invention essentially comprises a packaging machine which receives bags containing a predetermined number of patties, the handling and disposition of the bagged patties is far different from the manual operation contemplated by said patents. Rather, the packaging machine of the present invention is highly capable of operating at far greater speed than the machines of said patents, such as of the order of five seconds being required from the time a loaded bag is engaged by evacuating mechanism and ultimately is placed in a predetermined space in a carton. All such operation is automatic with the exception of an operator being required to extend the excess portion of the upper end of the bag around evacuating mechanism and then by means of manual switches, clamps are automatically brought into engagement with the upper end of said bag while evacuating mechanism is lowered into contact with the upper end of the stack of patties in the bag to evacuate the same and a plunger unit of the evacuating mechanism then is retracted but a co-axial hold down rod remains in contact with the upper end of the stack of patties in the bag while vacuum contines to be applied to the bag, this resulting in a contracted neck being formed from the excess length of the upper portion of the bag which, after retraction of the hold down rod, is still under vacuum and is quickly moved to a clip applying unit which automatically places a clip around the contracted neck.

Other features of the invention which are described in detail hereinafter comprise heat-shrinking the bags around the stack of patties therein, not only for purposes of effecting sanitary conditions within the bag out, of similar importance, the appearance of the patties in the bag is much more realistic and attractive to the purchasing public and improved storage and shelf life is produced.

Another important advantage of the present invention is that the products are not touched by human hands during any stage of the operation of either the bag loading mechanism or the evacuating and sealing mechanism comprising the present invention and, still further, all automatic operations occur under controlled conditions of such type that if any malfunction occurs, the mechanism is stopped until the malfunction is corrected. The control mechanism for the machine preferably is performed by solid state electronic circuits which essentially are contained on readily removable and replaceable circuit cards, said circuits controlling pneumatic air systems which operate pneumatic valves that are controlled electronically by said electronic circuits.

Figure 2:
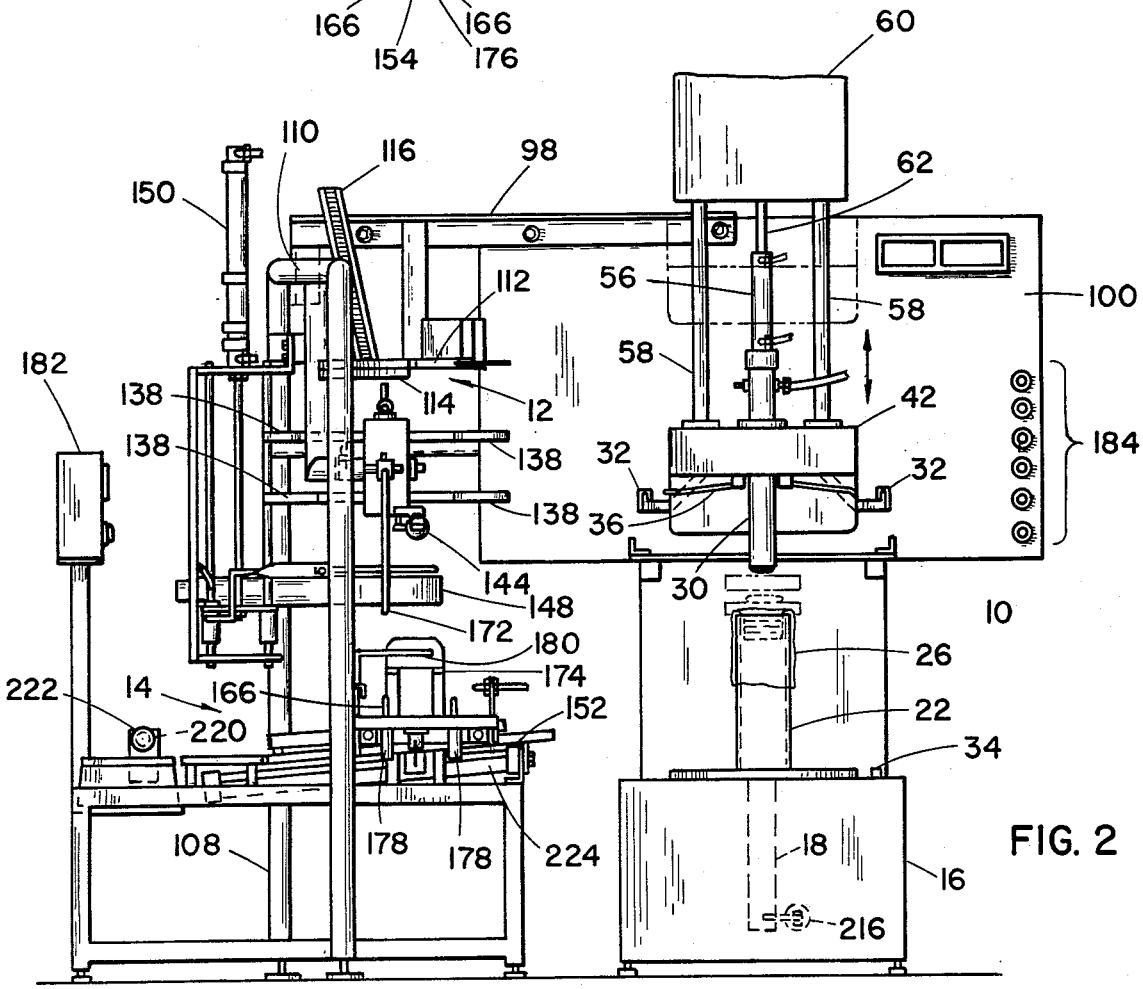
FIG. 2 is a front elevation of the machine shown in FIG. 1.
Figure 3:
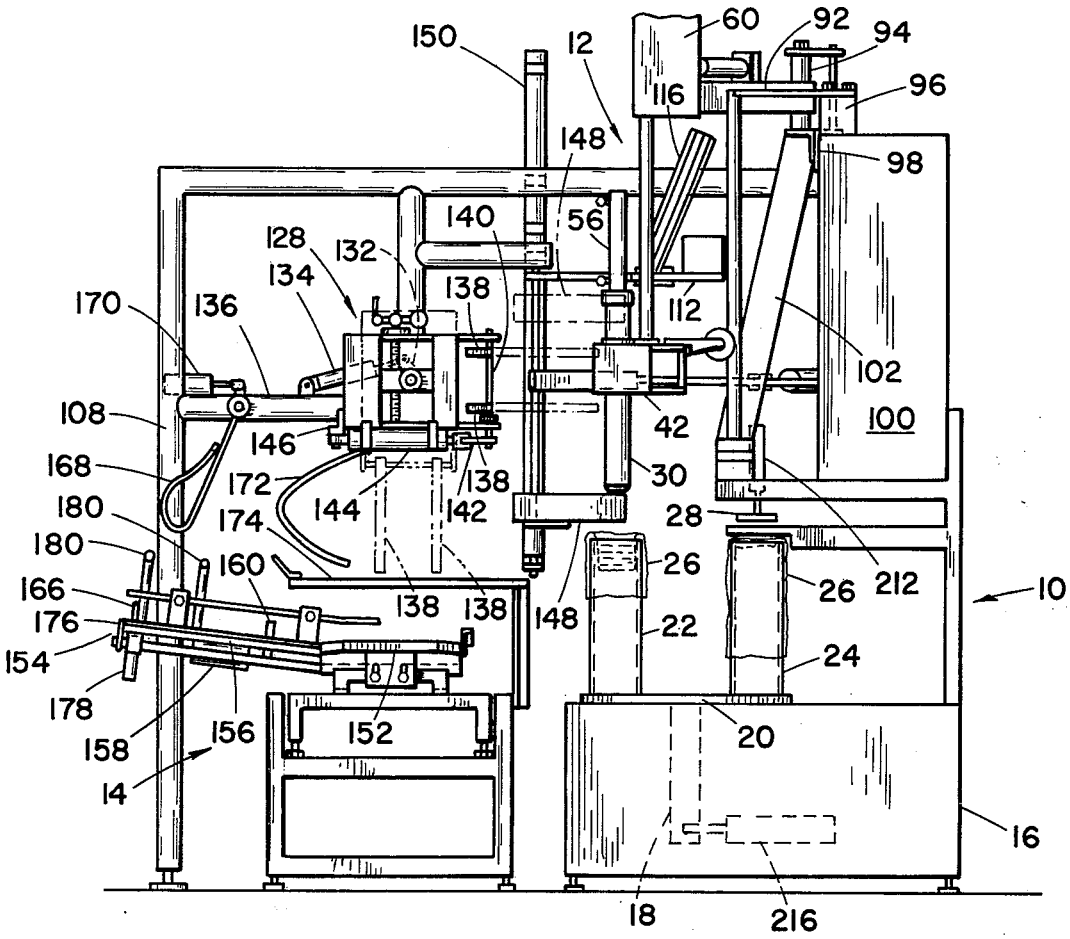
FIG. 3 is a side elevation of the machine shown in FIG. 2 as viewed from the right hand side thereof.

Referring to FIGS. 1–3, the entire machine is illustrated respectively to top plan view, front elevation, and side elevation. There are three principal sectors in the machine which respectively comprise the loading and evacating unit 10, the clip-applying unit 12, and the carton loading and weighing unit 14. The loading and evacuating unit 10 preferably contains the bag loading mechanism of applicant's prior U.S. Pat. No. 3,849,969, particularly in regard to the bag supporting means. The unit 10 comprises a base cabinet 16 within which a vertical shaft 18 is mounted to support a rotatable plate 20 upon which a pair of similar bag-packing cylinders 22 are fixedly mounted. Said cylinders are of sufficient length to accommodate the longest bags of hamburg patties contemplated to be handled by the mechanism, as in said prior patent.

As seen in FIG. 3, the cylinder 22 is illustrated with a bag 26 which has been loaded and the excess length of the bag is still draped around the exterior upper portion of the tube 22, while the tube 24 is in process of receiving a supply of patties and will be seen in this figure that the bag 26 has been inverted over said tube and a much greater length of the upper portion thereof is draped down around the cylinder 24. Accordingly, as the patties are individually delivered to the upper portion of the tube 24 they are depressed into the bag by a reciprocating piston head 28 having a fixed stroke which depressed each patty into the bag a distance equal to the thickness of each patty. By this means, the patties, which preferably have sheets of paper extended around the upper and lower surfaces of alternate patties are delivered to the upper end of the cylinder 24 for engagement by the piston head 28 and thereby positively force the patties into the bag 26 which causes the lower end of the bag to gradually move downward while the draped upper end thereof moves upwardly until the position such as shown with respect to cylinder 22 and bag 26 is reached. The bags 26 are precisely loaded with a predetermined exact numbers of patties which is controlled by a counting mechanism and, when the exact count has been reached with respect to the bag being filled, the operating mechanism by which the plate 20 is rotated is actuated to move the plate 20 180°. Meanwhile, the filled bag from one of the cylinders has been carried to the evacuating and clipping mechanism, described hereinafter and a new bag is draped over the cylinder 22 or 24 with the bottom uppermost.

Figure 4:
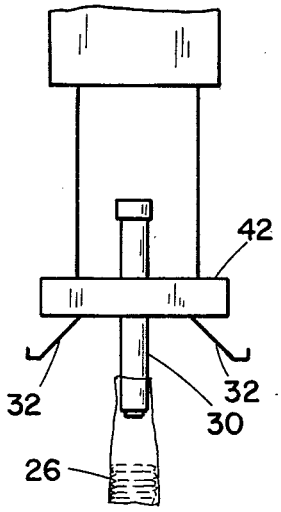
FIGS. 4 – 7 are diagrammatic views of the evacuating mechanism, said views respectively showing successive steps in the operation of said mechanism.
Figure 5:
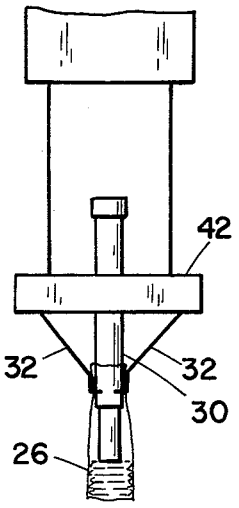
Figure 6:
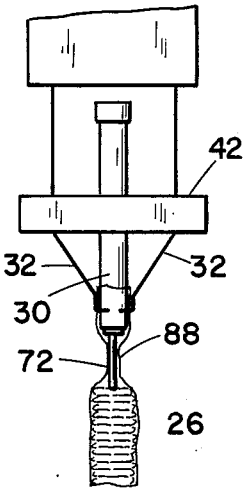
Figure 7:
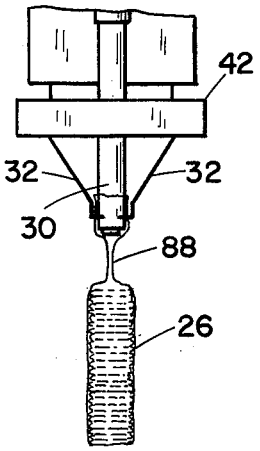

The bags 26 preferably have a greater length than the height of the stack of patties to be contained therein so that preferably six or seven inches of excess bag material is present for purposes of the same being draped around an outer cylinder 30, around which the upper end of the bag is tightly clamped, automatically, and preferably in air tight condition by means of pivoted clamps 32 such as illustrated diagrammatically in FIGS. 4 and 5.

With reference to the foregoing, it is to be understood that the principal purpose of the present machine is to eliminate as much manual operation as possible and this has been achieved to the extent that only a single operator is required to operate the machine and effect filling and sealing of the bags in approximately five seconds time so that between ten and twelve bags may be processed each minute of operation of the machine. The operator first places a bag 26 in inverted manner over the packing cylinder 22 or 24 which is foremost with respect to where the operator is standing, said position being in front of the cabinet 16 and facing it. Immediately upon the bag being draped over the outermost cylinder, the operator pushed one switch button 34 which is on the base cabinet 16 adjacent the front thereof. This signals the control mechanism, described in detail hereinafter, that the empty cylinder is fitted with a bag while the other cylinder is in process of being loaded with patties. As soon as the count has been reached in the bag being loaded, the rotatable plate or table 20 is rotated 180° to dispose the filled bag foremost and the empty bag in position to receive patties from the delivery conveyor of the type shown in applicant's prior U.S. Pat. No. 3,849,969.

Figure 12:
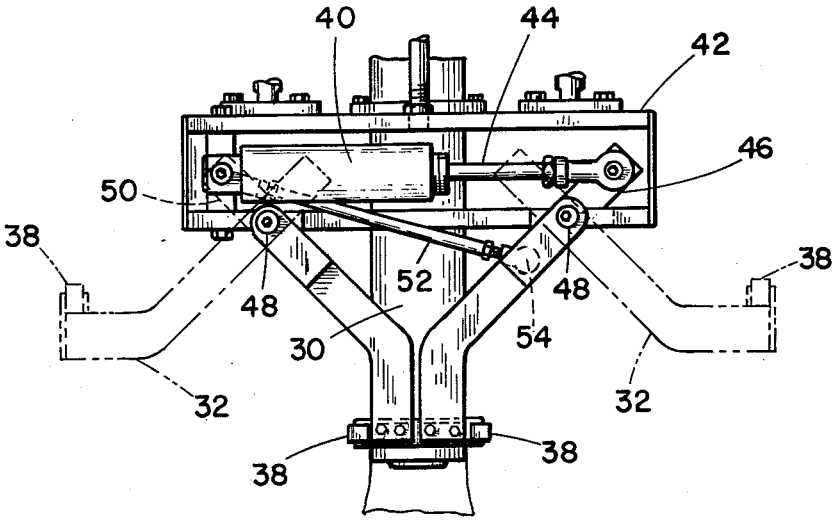
FIG. 12 is an enlarged fragmentary rear elevation of the mechanism shown in FIG. 11, the clamps being shown in clamping position in full lines and in expanded, inoperative position in phantom.

The aforementioned rotation of the plate 20 disposes the filled bag foremost and when this occurs the operator performs the only additional manual operation necessary in accordance with the present invention. This comprises manually engaging the draped excess upper portion of the bag 26 and disposing it around the outer surface of the outer cylinder 30 of the evacuating mechanism, followed by the operator actuating the switch levers 36 simultaneously which initiates movement of the pivoted clamps 32 against the upper portion of the bag 26, preferably in an air tight manner. Referring to FIG. 12, it will be seen that the pivoted clamps 32 have arcuate gripping members 38 at the outer ends thereof, the curvature thereof being complementary to the circumference of outer cylinder 30 of the vacuum unit.

Figure 11:
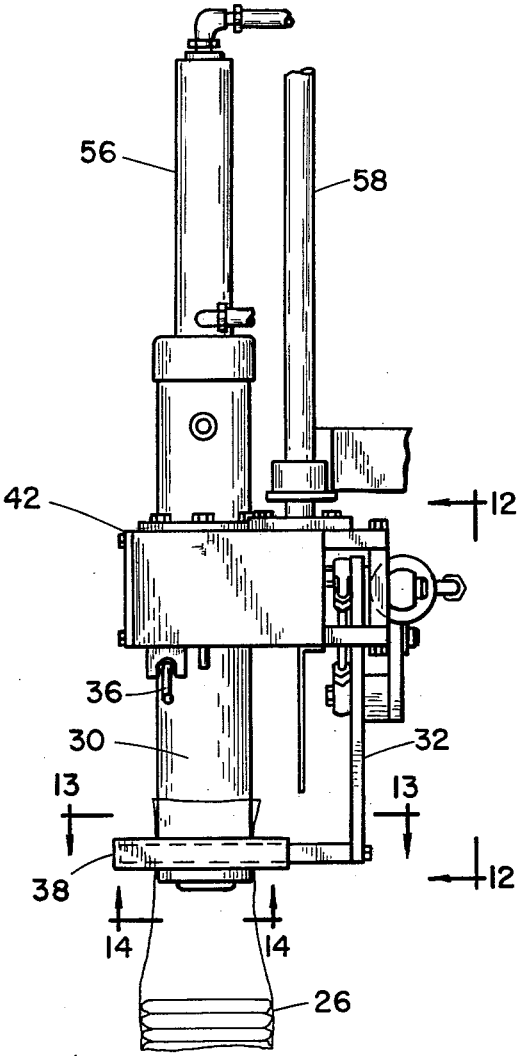
FIG. 11 is a side elevation of the evacuating unit showing the clamps for the bag in clamping position.
Figure 13:
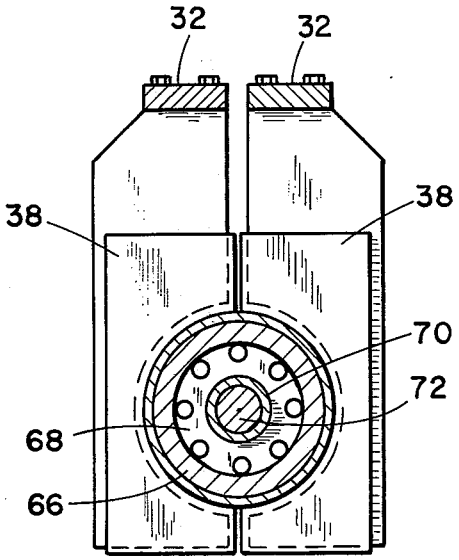
FIG. 13 is a transverse sectional view of the mechanism shown in FIG. 11 as seen on the line 13—13 thereof.

Actuation of the pivoted clamps 32 is effected by air cylinder 40, one end of which is pivotally connected to a head 42 to which the outer cylinder 30 is fixedly connected as can also be seen in FIG. 11. The piston rod 44 is air cylinder 40 is pivotally connected to extension 46 on one of the pivoted clamps 32, beyond the pivot 48 thereof. Another pivot 48 supports the other pivoted clamp 32 which has another extension 50 thereon and a link 52 is pivotally connected to the outer end of extension 50 and the other end of the link is pivoted at 54 to the first mentioned pivoted clamp 32. Accordingly, it will be seen that as the cylinder 40 projects the piston rod 44 outwardly, the right hand clamp 32 will be moved from phantom position to the full line position thereof and such movement, by means of line 52, simlarly causes the left hand pivot clamp 32 to move from phantom to the clamping position thereof shown in full lines in FIG. 12.

EVACUATING UNIT

Projecting from the upper end of outer cylinder 30 is a pneumatic cylinder 56, the opposite ends of which are respectively connected to conduits from an air pressure system. The outer cylinder 30, head 42 and cylinder 56 are vertically movable as a unit with respect to a pair of guide rods 58, see FIG. 2 which extend downwardly from a vertical housing 60 which contains another air cylinder from which a position rod 62 extends, the lower end of which is connected to the head 42 and the purpose of this is to raise and lower the assembled head 42, outer cylinder 30 and pneumatic cylinder 56 for purposes of raising an evacuated bag 26 from the bag packing cylinder 22 or 24 after the bag has been evacuated by mechanism now to be described.

Figure 8:
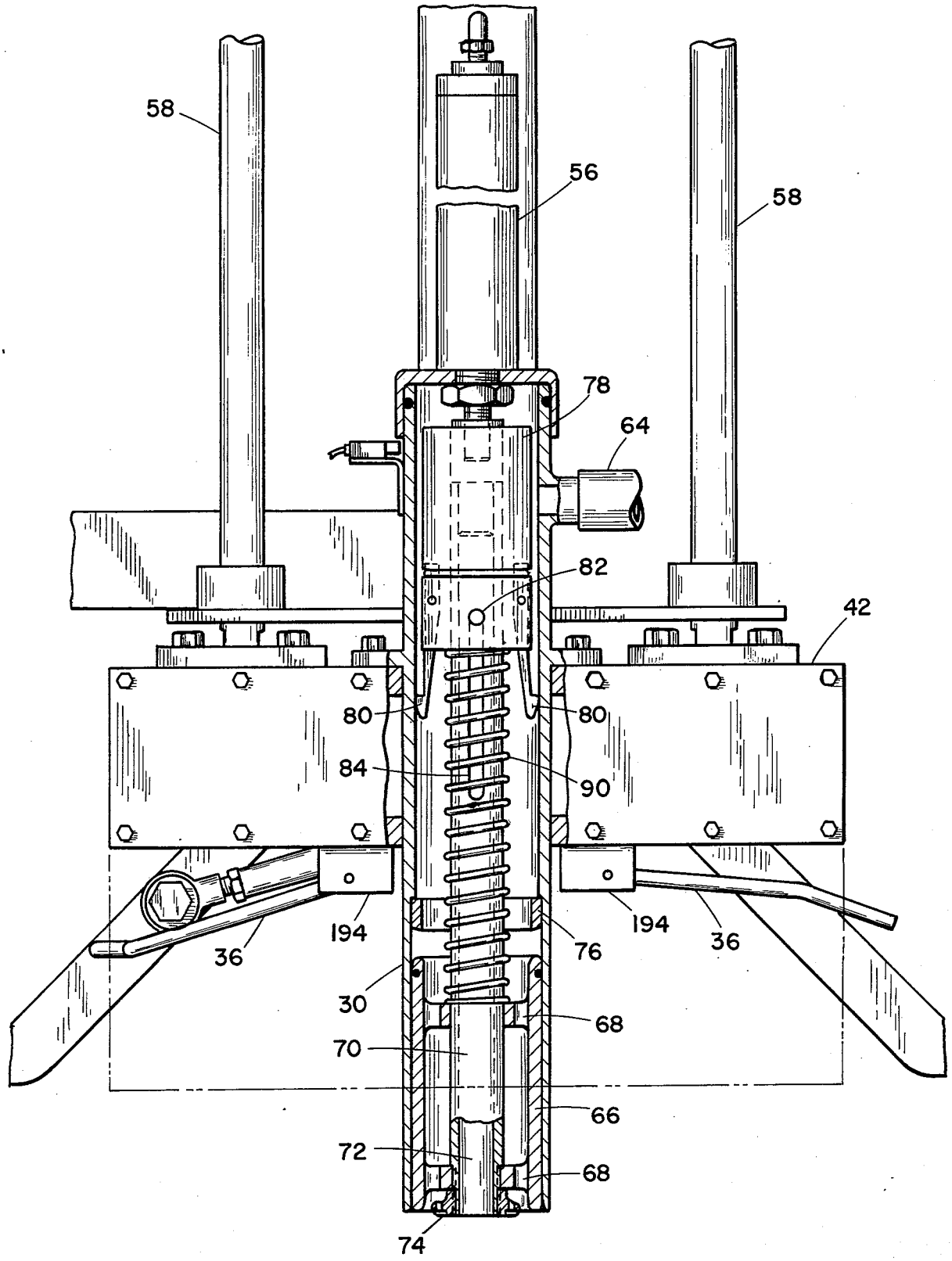
FIG. 8 is an enlarged fragmentary vertical sectional view of the evacuating mechanism of said machine.
Figure 9:
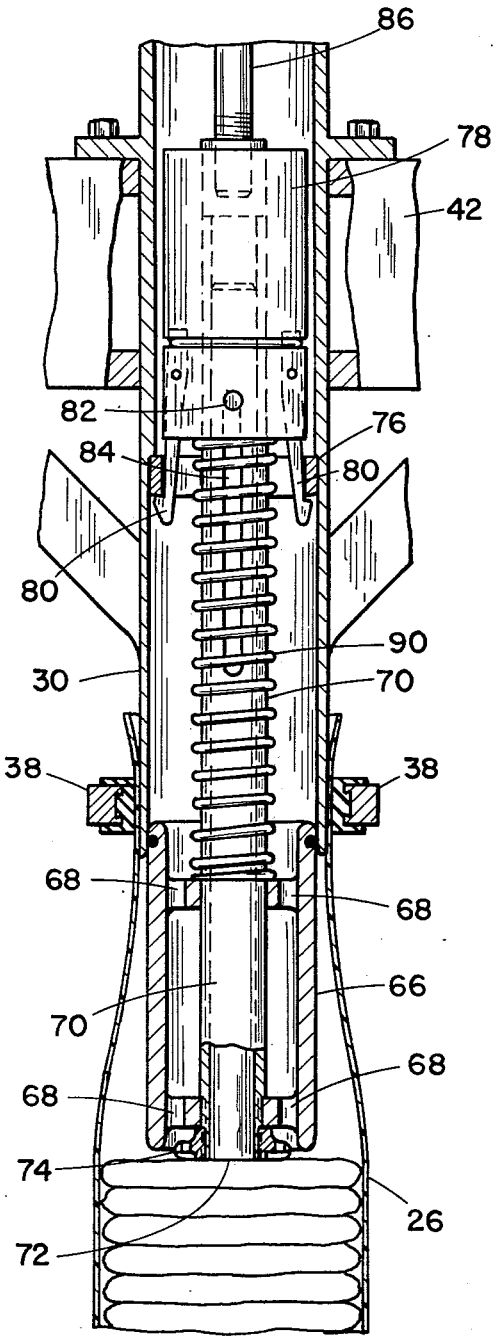
FIG. 9 is an enlarged fragmentary vertical sectional view of the evacuating mechanism showing the plunger unit thereof in lowered position against the stack of objects in a bag.
Figure 14:
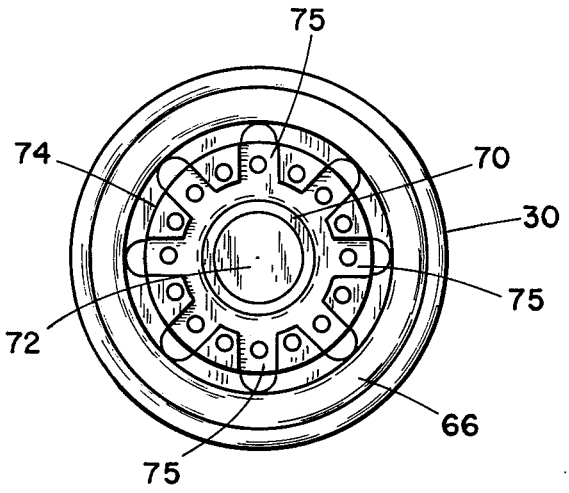
FIG. 14 is a bottom plan view of the neck shown in FIG. 11 as seen on the line 14—14 thereof.

As indicated above, the outer cylinder 30 is fixed relative to head 42 as more clearly shown in FIG. 8. A vacuum port 64 also is connected to the interior of outer cylinder 30 as shown in FIG. 8. Slidable within the lower portion of the outer cylinder 30 is a plunger unit 66 which is slidable within the cylinder 30 and transverse inner members 68 have ample ports formed therein for the transmission of vacuum and air. Plunger unit 66 is connected to the lower end of central guide tube 70 which extends upward to pneumatic cylinder 56. The lower end of guide tube 70 is threaded to receive presser head 74, the lower surface of which is provided with a plurality of radially extending passages 75 see FIG. 14, for purposes of permitting the passage of air therethrough incident to evacuating the bag 26 even though the presser head 74 is in direct contact with the uppermost pattie in the bag 26. The upper end of guide tube 70 is connected to the piston rod 84 of cylinder 56 which effects actuation of the plunger unit 66. Fixed within the outer cylinder 30 intermediately of the opposite ends thereof is a latching ring 76. A latching head 78 has a pair of downwardly extending, hook shaped latches 80 yieldably connected thereto and said head is connected to the hold down rod 72 by a pin 82 which extends through head 78 and is slidable within slot 84 in central guide tubes 70. When a bag of patties 26 has been clamped to the outer cylinder 30 by the gripping members 38, the control mechanism of the machine is set to successively perform in rapid manner a number of sequential operations automatically. The first of these is to activate cylinder 56 to project the piston rod 86 thereof downwardly so as to also project the plunger unit 66 a predetermined distance beyond the lower end of outer cylinder 30. Such movement also carried the latching head 78 downwardly and effects engagement of the latches 80 with the latching ring 76. This movement carries the presser head 74 and lower end of hold down rod 72 substantially into engagement with the uppermost pattie in bag 26 as shown in FIG. 9. In actual practice, such downward movement of the plunger unit 66 is approximately four inches but this is not to be considered restrictive. Simultaneously, gripping members 32 clamp the bag top tightly around cylinder 30.

Figure 10:
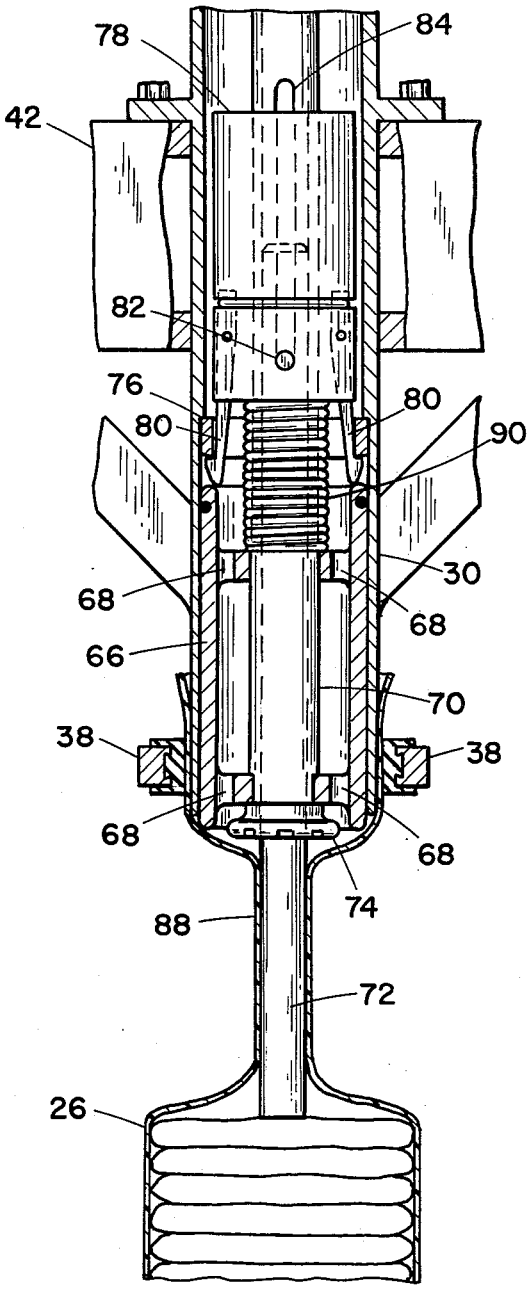
FIG. 10 is a view similar to FIG. 9 but showing the vacuum unit retracted but the hold down rod still lowered against the stack of objects to effect a contracted neck in the bag for said objects.

During such downward movement of the plunger unit 66, the control elements of the pneumatic system connect the interior of outer cylinder 30 to a vacuum by means of port 64. Such evacuation occurs instantaneously and the closing movement of gripping members 32 activates piston rod 62 to raise head 42 a distance greater than the length of filled bag 26 to remove the same from packing cylinder 22 or 24. At a point just prior to full withdrawal by rod 62, an electronic switch and air valve causes cylinder 56 to raise plunger unit 66 to the retracted position shown in FIG. 10, while the hold down rod 72 remains projected for an instance in order to form a neck portion 88 in the upper end portion of the bag 26. Were such operation not effected, the vacuum applied to the outer cylinder 30 would be such that the contents of the bag 26 would immediately be drawn against the retracted lower end of a plunger unit 66 and prevent the formation of any neck for a securing clip to be attached. It is only necessary for the hold down rod 72 to remain projected an instant while plunger unit 66 is retracted to the position shown in FIG. 10 and this compresses coil spring 90 which surrounds the guide tube 70 between upper end of plunger unit 66 and head 78, as shown in FIG. 10. During the extreme last portion of the upward movement of plunger unit 66, the upper end thereof camingly engages the sloping lower ends of the latches 80 and cam the same from engagement with the fixed ring 76. This instantaneously results in the spring 90 expanding and carrying the head 78 and hold down rod 72 upwardly but the neck 88 remains for a clip to be placed thereon.

After the foregoing operation has occured, the vertical housing 60 which contains a pneumatic cylinder from which piston rod 62 projects is fully retracted and actuates an electronic switch and air valve to retract cylinder rod 104, causing housing 60, with head 42 and bag of patties to swing the same to the clip-applying unit 12. For this purpose, the vertical housing 60 is connected to the outer end of a support arm 92, the inner end of which is fixed to a support shaft 94 of a heavy duty bracket 96, as best shown in FIG. 1. The bracket 96 is fixed to a rigid upper frame member 98, said frame member also supporting a cabinet 100 within which all of the electronic switch gear and pneumatic control valves are contained. A bracing leg 102 also extends downward from said frame member 98.

Swinging of the arm 92 to move the head 42, to which the evacuated bag is connected by clamp 32, to the clip-applying unit 12 is accomplished by means of pneumatic cylinder 104, see FIG. 1, one end of which is pivotally connected to arm 92 intermediately of the ends thereof as shown in FIG. 1, and the opposite end is connected to a bracket 106 on frame member 98.

CLIP-APPLYING UNIT

The frame of the machine also includes a vertical post member 108 shown in FIGS. 1–3, and a top, horizontal frame member 110. The clip-applying unit 12 comprises a horizontal plate 112 upon which a conventional, commercial type clip-applying unit 114 is mounted to receive C-shaped clips stored in magazine 116. A clamping arm 118, see FIG. 1, is pivotally moved clockwise after the contracted end 88 of an evacuated bag of patties has moved into notch 120 in the plate 112. The arm 118 is of a compound nature and includes a gripping surface as well as a shearing edge to trim the excess amount of the upper end of the bag 26 so as to separate it from the bag and permit it to be blown automatically from the machine. It also is to be understood that immediately upon the contracted end of a bag being received in notch 120, a switch is actuated to perform all previously described function of the clip-applying unit.

Due to the fact that a bag of hamburg patties which may contain for example, 20 to 50 patties, has substantial weight. When said bag is swung by arm 92 from the evacuating unit 10 to the clip-applying unit 12, there is a tendency for the lower end of the bag to swing outwardly. Due to the fact that time is of the essence in this entire operation, swinging of the bag must be eliminated and this is accomplished by a bag stabilizing arm 122 which is mounted upon a pivoted arm 124 see FIGS. 1–15, said pivoted end of the arm being connected to frame member 98. Actuating pneumatic cylinder 126 is arranged with the piston rod thereof connected to arm 124 intermediately of the ends thereof and the opposite end of the cylinder is pivotally connected to frame member 98. Control means for the bag stabilizing arm 22 include positioning the arm 122 in a first position similar to that shown in FIG. 1 to damp the movement of the bag and then the arm 124 is moved clockwise to carry the stabilizing arm 122 to a retracted, inoperative position to enable the bag transfer unit 128 to function.

The bag transfer unit 128 is a rectangular frame mounted upon a horizontal pivot 130 from which a crank arm 132 extends, see FIG. 1, for actuation by a pneumatic cylinder 134, one end of which is anchored to horizontal frame member 136 shown in FIG. 3. Projecting from one side of the transfer unit 128 are two pairs of C-shaped clamping arms 138 mounted upon shafts 140. A crank arm 142 extends radially from the lower end of shaft 140 and is connected to the piston rod of another pneumatic cylinder unit 144, the opposite end of cylinder unit being pivotally connected to a bracket 146 fixed to the frame of transfer unit 128. The clamping arms 138 are shown in plan view in FIG. 1. Meshing gears are on one end of shafts 140.

Immediately upon the evacuated bag being clamped within the clip-applying unit 12, cylinder unit 144 is actuated to bring the pairs of clamping arms 138 firmly into contact with the outer surface of a filled and evacuated bag 26 which furnishes a quick steadying of the bag. This is for purposes of permiting a heat-shrinking ring 148 to be moved from its lower position shown in full lines in FIG. 3, to the upper phantom position shown in said figure for purposes of traversing the entire length of the bag and shrinking it into close conformity with the contents therein. The ring 148 is moved from its lower, inoperative position shown in full lines in FIG. 2, upwardly to its uppermost position by means of the pneumatic cylinder 150, shown in FIGS. 2 and 3.

As the heat-shrinking ring 148 commences to move upward, the bag which is suspended from the clip-applying unit is supported by the clamping means of said unit to permit the clamping arms 138 to be moved out of contact with the suspended bags in order that the ring 148 may move along the entire length of the suspended bag. The upper phantom position of the ring 148 is shown in FIG. 3. After the ring passes the clamping arms 138 they are restored to clamping engagement with the suspended bag 26. When ring 148 is uppermost, clamping arm 118 is unlatched and releases the bag of patties and simultaneously activates an electronic switch and air valve to cause transfer unit 128 to turn clockwise, as viewed in FIG. 3 to dispose the clamping arms 138 in the phantom position shown in said figure and the clamping arms 138 then are separated to permit the evacuated and clipped bag 26 to fall by gravity into a carton upon the guideway 152. When this is occuring, the heat-shrinking ring 148 is lowered to the starting position thereof shown in full lines in FIG. 3. When head 42 is over clip-applying unit 12, it actuates clamping arm 118 to closed position, severs excess bag top material and actuates an electronic sensor causing cylinder 104 to move arm 92 to starting position. Midway of such movement, an electronic switch is actuated which opens gripping members 38, shuts off the vacuum to port 64 and blows excess bag top scrap away.

CARTON LOADING AND WEIGHING UNIT

It is to be understood that a feed conveyor, not shown, is provided to feed cartons in end-to-end relationship along suitable guide means for delivery of the cartons to the outer end 154 of the receiving guideway 156 which is transverse to the first mentioned guideway 152. Beneath the receiving guideway 156 are appropriate pneumatic cyliners 158 respectively connected to a forward limiting finger 160 which is pivoted between an upright position and a reclining position. When in the upright position shown in FIG. 3, the finger 160 will stop movement of a carton onto the guideway 152. However, after a loaded carton has been moved by pusher blade 162 shown in FIG. 1, which is activated by another elongated pneumatic cylinder beneath the conveyor 152, to discharge the loaded carton onto weighing scale platform 164, the finger 160 is pivoted to its inoperative position and pusher fingers 166 on receiving guideway 156 positively push the next carton unto the guideway 152. Further, the pusher blade 162 is moved by indexing mechanism which advances the carton a distance equal to the diameter of one of the loaded, evacuated bags 26, such movement being controlled by the position of the bag transfer unit 128. The cartons are slected to hold a plurality of such loaded bags, such as of the order to two or three bags and the indexing of the carton corresponds to the number of bags to be contained in the carton before the loaded carton is finally moved unto the weighing scale platform 164.

The cartons, as introduced to the receiving guideway 156 are closed on the bottom but have upstanding flaps on the sides and ends of the carton. To insure that the leading flap will be in horizontal folded out position so as not to obstruct the introduction of loaded bags into the carton, a pivoted arm 168, operated by a pneumatic cylinder 170, both of which are shown in FIG. 3, engages the leading flap in a manner to dispose it in a horizontal position incident to the movement of the oncoming carton onto the guideway 152. An additional arm 172 is mounted to finally guide the carton into filling position upon the guideway 152 and guide rails 174 further maintain the newly received carton and the flaps thereof in open position.

The leading end of the oncoming cartons which approach the outer end 154 of receiving guideway 156 also are held in receiving position by a transverse plate 176 which, as seen in FIG. 2, is supported by a pair of small pneumatic cylinders 178 which cooperate with a pair of horizontal bars 180, see FIGS. 2 and 3. As indicated above, the empty cartons which are fed to the receiving guideway 156 have their flaps upstanding. As the leading end of the next carton moves a short distance unto the outer end of guideway 156, the side flaps will engage the horizontal bars 180. The small cylinders 178 also are sequenced at this time to move the transverse bar 176 upwardly against the bottom of the leading end of said oncoming carbon and thereby cooperate with the horizontal bars 180 to restrain further movement of said oncoming carton until after the carton held against pivoted finger 160 has moved onto the guideway 152.

After a carton has been fully loaded while supported by the guideway 152 and has been sequentially moved to receive sucessive bags 26 of patties or the like, the pusher plate 162, after the last bag has been loaded in the carton from the clamping arms 138, will move the carton to the left as viewed in FIGS. 1 and 2 and dispose the same upon the weighing scale platform 164. The weight thereof is recorded on the register head 182 and the recording remains visible until the next carton is weighed. This is for purposes of the operator being able constantly to observe the weight of the bags in the cartons. The reason for this is that during any given of patties from the conveyor to the loading unit 10 may vary slightly and if the variation is sufficient to warrent adjustment of the number of patties is be loaded into the bags, the operator then may actuate one of the push buttons 184 to either add or subtract the number of patties that are to be loaded into the individual bags. A bank of such push buttons is illustrated in FIG. 2 and these buttons are connected with control means of the pattie delivery machine such as that shown in applicant's prior U.S. Pat. No. 3,849,969.

Reference has been made in the foregoing to the speed at which the machine comprising the present invention operates for purposes of loading, evacuating, clipping the upper end closed, heat-shrinking the bags and depositing them in the carbon which is indexed to receive the newly presented bags. The entire operation from the time the bag is loaded and the upper end is clamped around the outer cylinder 30 until the bag is released from the clamping arms 138 for deposit into a carton occurs within an interval of five seconds. Further, it is to be understood that while the bag is being loaded with patties, the previously loaded bag is evacuated and removed from its bag packing cylinder 22 or 24, after which the evacuated bag is swung to the clip-applying unit 12 and the carton loading weighing unit 14 and meanwhile the rotatable plate or table 20 has been rotated 180° to present a new bag to the loading mechanism while the last bag which is loaded follows through the aforementioned sequence. Therefore, it will be seen that more than one bag is being pressed by the various units referred to and this is also partly responsible for the great speed at which the present invention is capable of operating. Further, as soon as the bag transfer unit 128 has discharged a completed bag of patties into the carton, said unit 128 is returned instantly to the position shown in full lines in FIG. 3 and in which the arms 138 engage the next oncoming bag.

CONTROL SYSTEM

Figure 16:
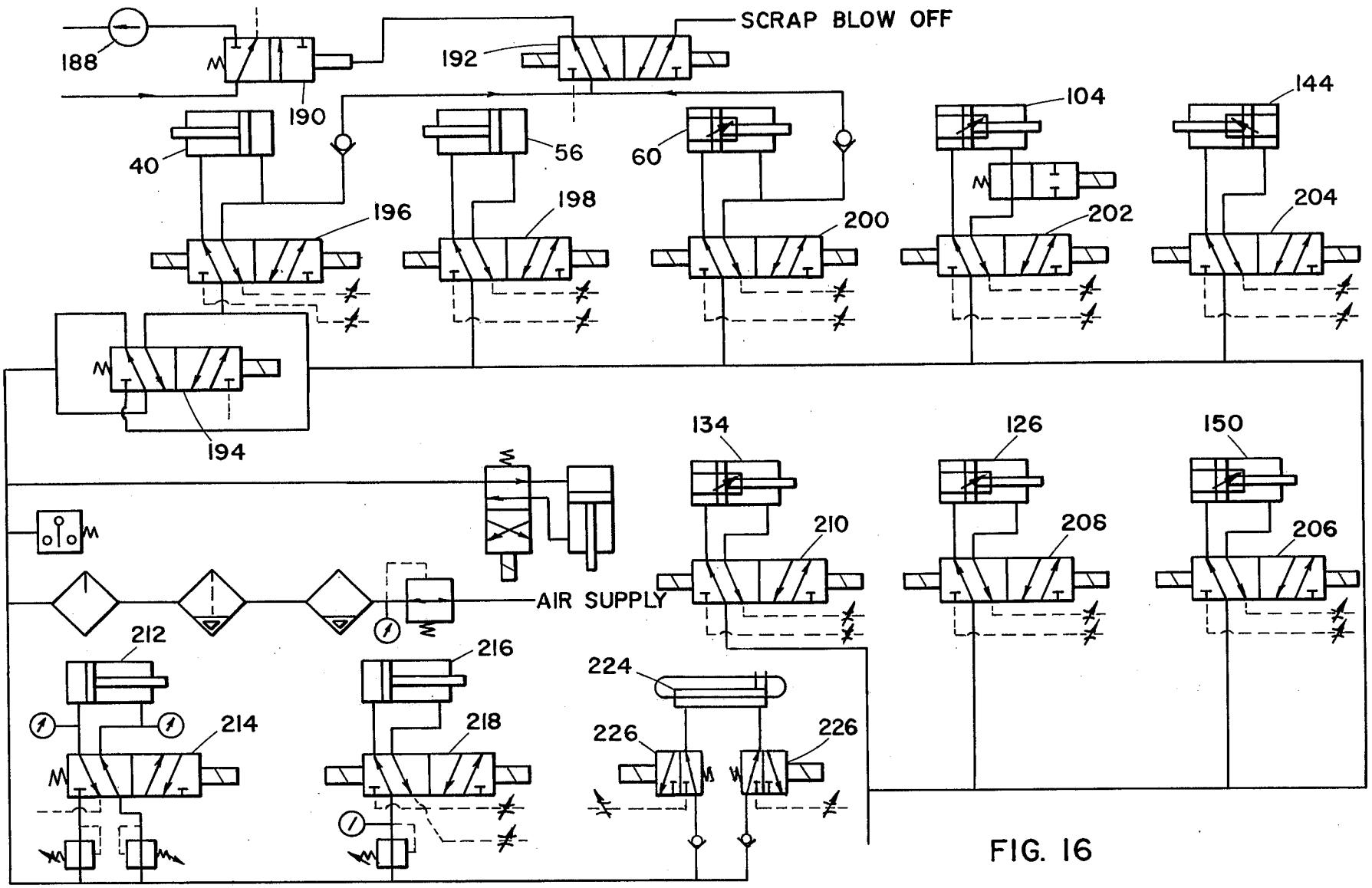
FIG. 16 is a schematic view of the pneumatic valve and electric switch system of the machine.

From FIG. 16, it will be seen that the various movable members of the overall machine comprising the present invention are actuated by pneumatic cylinders, the operation of which is controlled by valves such as included in the flow diagram comprising FIG. 16. At least the majority of said valves are mounted in the control cabinet 100. In general, switches of a magnetic nature and of the reed type are connected to the air cylinders and/or electronic snesors at various locations to provide the sequential operating cycle of the machine. For reliability, compactness and efficiency, the entire control system utilizes solid state logic, (CMOS). All of the valves are solenoid operated and electronic logic provides the output to the solenoids of said valve. In some instances, permanent magnets are mounted upon the piston rods within the cylinders so as to be movable with the rods. Also, the reed switches are connected to cylinder housings by means permitting longitudinal adjustment of the switches along the cylinders and thereby permitting variations in the timing cycle of the various movable elements of the machine. In the reed switches, one leaf preferably is rigid and the other is flexible so as to be movable by a magnet when passing in the vicinity of the reed switch.

Referring to FIG. 16, and also, where pertinent, to the other Figures in the drawings, the pneumatic circuit includes a vacuum pump 188 in which vacuum switch 190 is connected to circuit. Said circuit also is connected to valve 192 which supplies blow off air to remove the scraps from the clip-applying unit after the clip has been applied. Master air valve 194 is actuated by the master switch of the system and turns the air supply on and off.

Valve 196 controls the operation of air cylinder 40 by which the pivoted clamps 32 are operated to clamp the upper end of the bag around the outer cylinder 30. Cylinder 56 which controls the raising and lowering of the plunger unit 66 and hold down rod 72 is controlled by valve 198 for movement in opposite directions. The pneumatic cylinder is vertical housing 60 which raises and lowers head 42 is controlled by valve 200 for movement in opposite directions.

Pneumatic cylinder 104 which effects swinging of the arm 92 through an arc of 90° is controlled for movement in opposite direction by valve 202. Pneumatic cylinder unit 144, which actuates the bag clamping arms 138, is controlled by valve 204. The vertical pneumatic cylinder 150 which raises and lowers the heat-shrinking ring 148 is controlled for movement in opposite directions by valve 206.

The pneumatic cylinder 126 which is connected to arm 124 to which the stabilizing arm 122 is connected is controlled by valve 208 for movement in opposite directions. The pneumatic cylinder 134 which actuates crank arm 132 for purposes of pivoting bag transfer unit 128 about its horizontal pivot is controlled by valve 210.

Referring to FIG. 3, pneumatic cylinder 212, which is fixedly supported by the lower end of bracing leg 102 and actuates the rapidly reciprocating piston head 28 to pack the delivered patties forcibly into the bag 26, is controlled by valve 214.

Referring to FIG. 2, elongated peumatic cylinder 224 which is immediately below the guideway 152 and parallel thereto is controlled by valve 226. Also, positioned parallel to the cylinder 224 is a rod on which a number of electronic sensors are mounted at adjustable longitudinal spacings. The spacing of the sensors is in accordance with the indexing of the carton with respect to the bags 26 delivered thereto, whereby the movement of the carton is stepwise upon the guideway 152 to dispose a space within said carton immediately below the next bag 126 to be lowered by the bag in the carton, the carton then is indexed a distance amounting to the diameter of one bag to dispose the next space in line for receiving another bag 26. When all spaces within the carton have been loaded, the control mechanism moves the pusher plate 162 substantially to the end of guideway 152 so as to deposit the loaded carton upon the weighing scale platform 164. After a given carton has been weighed and the weight is displayed upon the register head 182, pneumatic cylinder 220, see FIGS. 1 and 2, is actuated in a direction for shoe 222 to be moved across weighing scale platform 164 and push the loaded and weighed carton onto a suitable removal conveyor or skid, not shown, which is aligned with the platform 164. Operation of the cylinder 220 is controlled by valve 224.

In regard to operation of the aforementioned valves, it is to be understood that they are of the solenid type and the electronic circuits thereto include either electronic sensors or reed switches which, in general, are adjustably positionable upon the means which support them and, in general, such means comprise the cylinders which are controlled by the valves.

Assume the packing cylinder 24 is in foremost position, the single operator places a bag 26 over the same and then presses switch button 34 to indicate such condition in the control circuit. As soon as the bag 26 in packing cylinder 22 has been filled and rotatable plate 20 has moved the cylinder 22 to foremost position, the operator quickly extends the upper end of the bag around the outer cylinder 30 and then presses switch levers 36 upwardly to operate valve 194 to cause cylinder 40 to move the pivoted clamping arms 32 into firm engagement with the portion of the bag on outer cylinder 30. Simultaneously, cylinder 56 is actuated to project the plunger unit 66 and hold down rod 72 to the extended position shown in FIG. 9 in which, the lower end of plunger unit 66 and the presser head 74 are either in contact with or immediately adjacent the uppermost pattie in the bag 26. When in this position, vacuum, through port 64, is created in cylinder 30 and evacuates the interior of bag 26 and closure clamps 32 activate cylinder rod 62 to raise head 42 a distance greater than the length of filled bags 26 to remove the evacuated bag from cylinder 22 or 24 and when the same is about 75% withdrawn, an electronic switch and air valve causes cylinder 56 to be actuated by valve 198 to withdraw the plunger unit 66 to the initial position thereof shown in FIG. 8 while the hold down rod 72 remains projected for an instant which is sufficient to cause the vacuum to form the neck portion 88 of the bag, whereupon the projecting end of hold down rod 72 is withdrawn but neck 88 remains tightly contracted.

When plunger unit 66 is fully extended, it activates the cylinder in vertical housing 60 which actuates piston rod 62 which is activated by valve 200 so as to move upwardly and withdraw the evacuated bag 26 from its packing cylinder 22 and immediately upon this occuring, cylinder 104 is activated by valve 202 to pull its piston rod inwardly and effect swinging of arm 92 to carry the exacuating head 42 to the clip-applying unit 12 where the contracted neck 88 of the bag is received in notch 120 of the clip-applying unit and clamping arm 118 is immediately actuated to clamp the contracted neck of the bag within the notch 120 and the excess portion of the bag above the clip which is applied automatically is severed from the bag. As soon as the neck of the bag is disposed in notch 120 and clamping arm 118 is closed against it, cylinder 126 is reversely actuated instantaeously to restore the arm 92 and the vacuum head 42 to its initial evacuating position. During such movement, vacuum to cylinder 30 is discontinued and the severed bag top is blown off.

Figure 15:
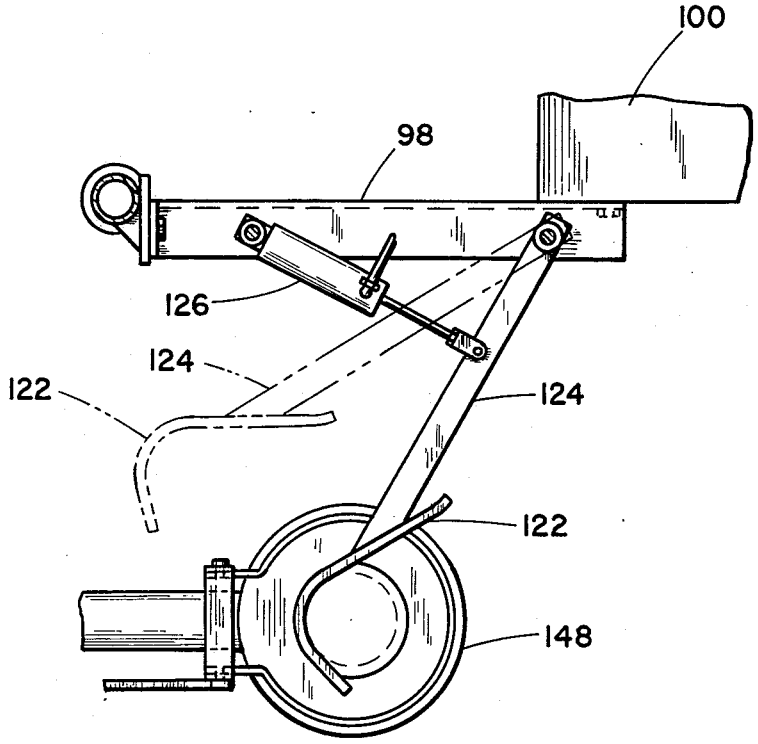
FIG. 15 is a fragmentary partial plan view of the stabilizing mechanism shown in FIG. 1 and illustrating the operative position thereof in full lines and the inoperative position in phantom.

Swinging of the bag to the clip-applying unit 12 is stabilized by engaging bag stabilizing arm 122 and immediately thereafter cylinder 126 is activated by valve 208 to move the bag stabilizing arm 122 to the phantom, inoperative position thereof shown in FIG. 15. While this occurs however cylinder 144 on bag transfer unit 128 is activated by valve 204 to move the clamping arms 138 from the extended, open position thereof shown in FIGS. 1 and 2 to a closed position in which they encircle the bag 26. This accurately establishes the bag in alignment with the heat-shrinking rink 148 whch at this time begins to rise by means of cylinder 150 which is actuated by valve 206. As the ring 148 rises, the fingers 138 are again opened by cylinder 144 to permit the heater ring 148 to move past the clamping arms 138, following which the arms 138 immediately are restored to bag encircling position. When heater ring 148 is in its uppermost position, clamping arm 118 is moved from clamping position in the clip-applying unit 12 and this permits pneumatic cylinder 134 to be activated by means of valve 210 to cause the bag transfer unit 128 to move clockwise, as viewed in FIG. 3, to lower the bag 26 which is engaged thereby to the discharge position in which the arms 138 extend downwardly as shown in phantom in FIG. 3.

Referring to FIG. 3, it will be seen that in the base cabinet 16 upon which the plate 20 is rotatable, suitable mechanism is included to rotate the vertical shaft 18 180°. Essentially, a pneumatic cylinder 216 is appropriately mounted within the base cabinet 16 and is controlled by valve 218 shown in FIG. 16. The piston rod of the cylinder 216 is suitably connected to the lower end of vertical shaft 18 by any appropriate means such as a crank, rack and pinion, or otherwise, not shown in detail, for purposes of effecting such oscillation of the rotatable plate 20. For further details of the contents of base cabinet 16, attention is directed to applicant's aforementioned prior U.S. Pat. No. 3,489,969, certain features of which are included in the present invention as representative of a different combination from anything shown in said prior patent.

The present invention also is characterized by substantial safety means being incorporated in the operating mechanism, especially to prevent malfunctions, jam ups and other undesirable occurances. To this end, it is to be noted that the operation of the entire machine embodies a sequential program which commences with the closing of the bag clamps 32, 38 and only when the clamps are in operative clamping condition can the vacuum plunger unit 66 be moved to the projected position thereof shown in FIG. 9 and as soon as the same has been fully extended to said position cylinder rod 62 lifts head 42 a distance sufficient to remove it from cylinder 22 or 24 and when about 75% removed, the elevating cylinder 56 is actuated to restore the plunger unit 66 to its normal position shown in FIG. 8 and at the end of such upward movement, the latches 80 are released to permit the spring 88 to return the hold down rod 72 to its retracted position. When the plunger unit 66 and hold down rod 72 are restored to their uppermost position and all other checks of the system are satisfied, the mechanism is in condition to have the arm 92 swung by cylinder 104 from the evacuating position to the clip-applying unit 12, in which position the bag is clipped shut and as soon as this has occured, the arm 92 is swung backward to the evacuating position and during such movement, the vacuum is shut off to the evacuating unit and the bag clamps are opened and the excess scrap from the top of the bag is blown off the machine.

Meanwhile, the bag 26 is clamped in the clip-applying unit and is engaged by the clamping arms 138, which movement initiates retraction of the stabilizer arm 122 and initiates upward movemet of the heat ring 148. As the heat ring approaches the clamped arms 138, they are opened to permit the heater to pass and then the clamp arms 138 are restored to clamping position while the heater moves to its uppermost position and doing so applies heat to the entire length of the bag so as to shrink the same tightly around the products therein.

When heat ring 148 is in its uppermost position, the clamping arm 118 is released from the clip-applying unit and the bag transfer unit 128 then is closed for rotatable movement of 90° to extend the clamping arms 138 downward while engaging a bag 26 and when in said lowermost position, the clamping arms 138 are opened to release the bag for deposit in a carton. When the clamping arms 138 have been opened, the control system is conditioned to effect return of the bag transfer unit 128 to starting position which is the position illustrated in FIG. 1–3 in full lines. When the bag transfer unit 128 is in its fully returned position, the system is in condition for a carton to be indexed to the next position upon the guideway 152 to receive a bag from the open arms 138. Finally, when the carton is filled, rather than the same being indexed to receive an additional bag, the carton is pushed automatically onto the scale, the pusher blade 162 is returned to starting position and when it has fully retracted to said position, the system is condition to admit an empty carton to the guideway 152 for reception of a load of bags therein.

From the foregoing, it therefor will be seen that the various steps comprising the operation of the machine can not be accomplished until all previous steps have occured, so that the entire operation is interlocked for safety purposes. Further, the electrical circuit is arranged with a row of switch buttons shown on cabinet 100 in FIG. 2 along the right hand end, certain of which control the operation of the heat-shrink ring 148 and the carton feeding mechanism. If it is desird to eliminate either of these functions at any time, this may be done quickly by operating the control switches.

The foregoing description illustration preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A high speed machine for loading a stack of similar flat objects into a flexible tubular bag longer than a stack of said objects to be delivered to the same and evacuate said container and contents, said machine comprising in combination:

a. a frame.

b. an arm supported at one end by said frame for pivoted movement about a vertical axis, c. a clip-applying unit supported by said frame, d. an evacuating unit connected to the other end of said arm and comprising in coaxial relationship an outer cylinder fixed to said arm, a plunger unit slidable axially in said cylinder, and a hold down rod centrally of said plunger unit, e. clamping members movably mounted adjacent said outer cylinder, f. power means operable automatically to move said clamping members firmly into engagement with the upper end of a bag when extended around the lower end of said outer cylinder, g. means to lower said plunger unit and hold down rod into contact with the stack of objects in said bag, h. means operable automatically and successively to apply vacuum to said plunger unit to evacuate said bag, with draw said plunger unit from said while said hold down rod remains against said objects in said bag, and continuing to apply vacuum to form a contracted neck of the upper end of said bag and then withdrawing said hold down rod, i. means to swing said other end of said arm to carry said evactuated bag hanging said outer cylinder to said clip-applying unit while maintaining said vacuum within said bag and, j. means to operate said clip-applying unit to apply a clip securely to said contracted neck of said bag.

2. The machine according to claim 1 in which said bags are formed of heat shrinkable plastic and said machine further including a heated-shrinking unit and means supporting said unit for movement along said bags while supported vertically at said clip-applying unit.

3. The machine according to claim 2 further including clamping means on said clip-applying unit engaging said contracted upper ends of said bags to hold the same while a sealing clip is supplied to said upper ends.

4. The machine according to claim 2 further including a bag stabilizing member adjacent said clip-applying unit and engageable by evacuated bags as the same are swung to said clip-applying unit to quickly stop swinging movement of said bags to permit movement of said heat-shrinking unit axially along each bag as supported with the upper end clamped to said clip-applying unit.

5. The machine according to claim 4 in which said heat shrinking unit includes a circular heater member mounted for vertical movement from an inoperative starting position adjacent one end of said bags coaxially with the axis of each bag suspended from said clip-applying unit, and means to retract said heater member to said starting position.

6. The machine according to claim 5 in which the operative shrinking movement of said heater member extends from the lower end of a suspended bag to adjacent the clamped upper end of said bag, and said machine further including means to restore said heater member to starting position automatically.

7. The machine according to claim 6 further including additional clamping members engageable sequentially with each bag after shrinking thereof intermediately of the opposite ends thereof while said heater member is uppmost, said additional clamping members being supported by pivoted means adapted to swing each clamped bag from said clip-applying unit and heater member and deposit said bags sequentially in a carton.

8. The machine according to claim 6 further including means to move said bag stabilizing member to an inoperative position following engagement thereof by a bag to stabilize the same, said inoperative position being clear of the path of movement of said heater member.

9. The machine according to claim 7 further including support means for carton positioned thereon to receive clipped and evacuated bags of objects, and means operable upon said support means to index the position of said cartons to align spaces therein sequentially to receive said bags in side-by-side relationship as deposited therein from said additional clamping members.

10. The machine according to claim 3 further including means to swing said other end of said arm reversely from adjacent said clip-applying unit to said bag packing cylinder after the upper end of each bag is clamped to said clip-applying unit.

11. The machine according to claim 10 in which said means to swing said other end of said arm comprises a pneumatic piston and cylinder unit connected at the opposite ends thereof respectively to said frame and said arms.

12. The machine according to claim 11 further including control means for said pneumatic unit respectively operable by switch means carried by said other end of said arm and actuated by retracting movement of said hold down rod to initiate swinging of said arm toward said clip-applying unit, and additional switch means adjacent said clip-applying unit engageable by clamping movement of each bag to said clip-applying unit, said switch means being connected to pneumatic valves in lines respectively connected to the opposite ends of the cylinder of said pneumatic unit.

13. The machine according to claim 10 further including additional control valve means in circuit with a vacuum supply line to said plunger unit and a switch connected to said valve means, said switch being positioned for actuation by the return swing of said unit to shut off vacuum to said plunger unit during the return movement of said arm to said bag packing cylinder.

14. The machine according to claim 13 further including additional control means on said evacuating unit comprising pneumatic valve means in a vacuum supply line for said unit and switch means to actuate said valve, said switch means being manually actuated by an operator when positioning the top of a bag around said outer cylinder to initiate the operating cycle of the machine including supply vacuum to said evacuating unit.

15. The machine according to claim 6 further including control means for said heater member operable to return said heater member to the lower inoperative position thereof automatically upon a switch malfunction or any obstruction to movement of said heater member occuring during the shrinking cycle of the machine.

16. A high speed machine for receiving a series of similar flat objects in a stack within a flexible impervious tubular bag closed at one end of greater length than the stack to be formed therein, said machine comprising in combination, a. a frame, b. an elongated evacuating unit supported vertically upon said frame and comprising, c. an outer cylinder supported upon said machine at a predetermined horizontal level, d. a plunger unit slidable axially in said outer cylinder and adapted to be projected below the lower end of said outer cylinder, and e. a push rod coaxial with said plunger unit, said rod being of a substantially smaller diameter than said plunger unit, f. port means on said outer cylinder connectable to a source of vacuum, g. a fluid operated cylinder and piston unit extending above said outer cylinder and said piston being detachably connected to said plunger unit for axial movement thereof within said outer cylinder, h. clamping means having arcuate jaws complementary to the lower end of said outer cylinder and pivotally movable to and from engagement with said outer cylinder to clamp the excess length of a loaded bag to said lower end of said outer cylinder, and i. activating and control means operable automatically after said excess length of a bag has been manually extended over the lower end of said outer cylinder to move the lower ends of said plunger unit and push rod into contact with the contents of said bag while vacuum is applied to said bag by said plunger unit, followed by withdrawing said plunger unit while said push rod remains in contact and vacuum still exists in said bag to form a concentrated neck on said bag above the contents thereof, and retracting said push rod from said contracted neck which is conditioned to have a closing clip applied thereto while maintaining a vacuum in said bag and neck.

17. The machine according to claim 16 further including;

j. means to apply a clip to each evacuated bag of patties, k. means to shrink the bag around said patties in said bag by heat, l. means selectively operable to bypass said heat shrinking means, m. means to remove said bags from said clip-applying means and/or said bag shrinking means and position the same into a carton, and n. means selectively operable to omit said positioning the bags in a carton and discharge them to a removal conveyor.

18. The machine according to claim 16 in which the lower end of said plunger has an uneven contour to transmit air from said loaded bag to evacuate the same when in contact with the uppermost object in said bag.

19. The machine according to claim 16 wherein the piston rod of said fluid-operated cylinder is connected to a head within said outer cylinder, and said machine further including hook members depending from said head for detachable engagement with the upper end of said plunger unit, said plunger unit being movable a limited axial distance below the lower end of said outer cylinder when said head on said piston rod moves downward for contact with said plunger unit and the upper end of said plunger unit having short laterally extending means engageable by said hooks to effect upward movement of said plunger unit from its extended position in said bag.

20. The machine according to claim 19 in which said push rod extends through said plunger unit from the lower end thereof in idle position upwardly to abutment with the lower end of said piston rod, and said machine further including a coiled compression spring surrounding said push rod, the lower end of said spring abutting the upper end of said plunger unit and the upper end of said spring engaging said head on said piston rod, said spring being compressed when said head is retracted and said hooks retain said head on piston rod in extended position, hook-disengaging means in said outer cylinder operable to disengage said hooks from said plunger unit when retracted into said outer sleeve, and means controlled by said plunger unit when retracted to release said coiled spring to effect retraction of said push rod from the contracted neck of an evacuated bag of said objects.

21. The machine according to claim 16 in which arcuate jaws of said clamping means engage said upper end of said bag firmly to clamp the same substantially in airtight engagement with the lower end of said outer cylinder.

22. A high speed machine for receiving a series of similar flat objects stack-like within a flexible impervious tubular bag closed at one end and comprising in combination;

a. a frame, b. an evacuating head supported by said frame and including a perpendicular outer tube and a plunger unit slidable therein and adapted to be connected to a source of vacuum, c. means to clamp the upper end of a flexible tubular bag to the lower end of said outer tube after being loaded with a stack of predetermined number of said objects, d. means to lower said plunger unit into said bag against said stack of objects and apply vacuum thereto, e. a clip-applying unit, f. means to move said evacuating head to said clip-applying unit while a vacuum is maintained upon said bag, g. means to operate said clip-applying unit to apply a closing clip tightly around the upper end of each bag, h. clamping transfer means to engage said bag after having a clip applied thereto and operable to transfer a plurality of said bags successively from said clip applying unit into a carton adapted to hold a plurality of said bags in orderly and compact arrangement, i. means to actuate said clamping transfer means to release said bags when moved to a predetermined discharge location above a carton, j. and indexing means operable to adjustably position said carton relative to said clamping transfer means to dispose a space in said carton below said discharge location for each of a plurality of said loaded bags as the same are released by said clamping transfer member.

23. The machine according to claim 22 further including a weighing scale and means to transfer a carton of said loaded bags automatically to said weighing scale.

24. The machine according to claim 23 further including means to remove a weighed carton automatically from said weighing scale and a conveyor adapted to move an empty carton indexed to positon to be loaded with additional bags of said objects.

25. The machine according to claim 22 in which said bags are heat shrinkable and said machine further including a heat shrinking member and means to move said member vertically relative to a bag of said objects while held suspended by said clip-applying unit to effect tightening of said bags around the stacks of products therein in addition to said bags being evacuated.

26. The machine according to claim 25 further including safety means operable relative to said clip-applying unit operable to insure that a previously clipped bag has been released and said unit is in condition to receive the upper end of a succeeding bag and that said heat shrinking unit is retracted to the starting position thereof.

27. A method of receiving a plurality of similar flat objects in stacked manner into a tubular bag closed at one end comprising the steps of:

a. holding said bag in position to receive a series of said objects from a feed conveyor, b. clamping the upper end of said bag tightly around a tubular evacuating unit including an inner slidable plunger unit and hold down rod, c. moving said plunger unit and rod into contact with the upper end of said stack of objects in said bag, d. applying vacuum to said plunger unit to evacuate said bag, e. withdrawing said plunger unit a limited distance upward from said objects while said hold down rod remains in contact with said objects to form a contracted neck on the upper end of said bag, f. withdrawing said hold down rod from said contracted neck while maintaining vacuum in said bag, and g. transferring said bag to a clip-applying unit for application of a tight clip around said contracted neck of said bag.

28. The method according to claim 27 in which said bags are heat shrinkable and further including the step of moving a heater ring along said bag of objects while suspended at the top of said clip-applying unit to shrink said bag tightly around said objects therein.

29. The method according to claim 28 including the further steps of trimming excess bag material from the closed top of the bag above the clip on the neck thereof and blowing said separated excess scrap material from the vacuum nozzle housing.

30. The method according to claim 27 including the further steps of removing from the clip-applying unit bags which have been clipped shut, positioning a carton to receive a plurality of said bags in close relationship, automatically moving said clipped bags from said clip-applying unit to said carton, indexing said carton successively to dispose clipped bags into available spaced in said carton until a full complement of bags have been deposited in said carton, and removing said carton and complement of bags for placement of another empty carton in position for indexing to receive a complement of bags.

31. The method according to claim 30 including the further step of transferring said cartons which have a full complement of bags to weighing scale and recording the weights thereof.

* * * * *